United States Patent [19]

Elliott

[11] 4,059,939

[45] Nov. 29, 1977

[54] PREFABRICATED BUILDING UNIT

[75] Inventor: Lillard H. Elliott, Monte Vista, Colo.

[73] Assignee: Elliott Enterprises of Monte Vista, Monte Vista, Colo.

[21] Appl. No.: 718,973

[22] Filed: Aug. 30, 1976

[51] Int. Cl.[2] ..... E04G 21/00

[52] U.S. Cl. ..... 52/745; 52/351; 52/363; 52/587; 264/35

[58] Field of Search ..... 52/600, 602, 367, 351, 52/348, 334, 360, 361, 362, 270, 363, 454, 315, 745; 264/35

[56] References Cited

U.S. PATENT DOCUMENTS

| | | | |
|---|---|---|---|
| 1,390,951 | 9/1921 | Baughman | 52/351 |
| 1,428,147 | 9/1922 | Davis | 52/587 |
| 1,460,682 | 7/1923 | Schleicher | 52/367 X |
| 1,902,271 | 3/1933 | Warner | 52/315 |
| 2,034,215 | 3/1936 | Stencel | 52/274 |
| 2,940,295 | 6/1960 | Post | 52/587 |
| 3,216,157 | 11/1965 | Pinter | 52/745 |
| 3,245,185 | 4/1966 | Rowe | 52/315 |
| 3,300,942 | 1/1967 | Horstman | 52/438 |
| 3,363,371 | 1/1968 | Villalobos | 52/349 |
| 3,942,294 | 3/1976 | Savell | 52/259 |

*Primary Examiner*—John E. Murtagh

*Attorney, Agent, or Firm*—Bertha L. MacGregor; Kyle W. Rost

[57] ABSTRACT

A prefabricated building unit has a framed inner stud wall to which is joined an intermediate wall of insulation board and an exterior wall of concrete, the concrete being poured on the intermediate wall and over angled, protruding nails that fasten the intermediate wall to the stud wall. A plurality of the building units are combined to complete the walls of a structure, the method of joining being to weld together reinforcing bars extending from the concrete portion of each unit and then to pour a pilaster over the joined reinforcing bar. The exterior of the concrete wall is finished during prefabrication with exposed aggregate and exterior varnish.

1 Claim, 3 Drawing Figures

PREFABRICATED BUILDING UNIT

BACKGROUND OF THE INVENTION

1. Field of the Invention

The invention relates to static structures and a method for building same. More specifically, a concrete and wood prefabricated wall unit and method for assembling the wall unit are described.

2. Description of the Prior Art

Prefabricated building units are well known in the prior art. Wooden building parts such as trusses and framed walls are frequently preassembled into a complete structure in a short time. The prefabricated units have the advantage of being designed and assembled under controlled conditions for uniformity of size and high quality.

Concrete wall units are also well known in the prior art, as evidenced by U.S. Pat. No. 1,355,572, which describes a building of concrete slabs held together by tie rods extending through horizontal bores in the slabs. Another prefabricated wall is described in U.S. Pat. No. 3,350,826, which discloses a method of attaching a precast concrete wall to a footing by placing vertical tie rods through bores in the wall and footing, and then grouting the rods in place. U.S. Pat. No. 3,330,084 discloses a wall panel joint cap that holds precast concrete slabs together and provides attachment points for roof trusses. Each of these patents demonstrates the difficulty in easily assembling prefabricated concrete slabs into a finished structure. Furthermore, the structure by which prior art patents suggest assembling the slabs has been precast bores in the slabs through which long tie rods are placed, or alternatively, casting the slabs in special frames that can accomodate long tie rods. Thus, a continuing problem in the prefabricated concrete building art has been to assemble precast slabs with a strong bond homogeneous to the concrete slab.

A further problem is to create an interior coating on the concrete wall that allows insulation and standard interior building apparatus to be applied. Framed walls have natural areas where insulation, plumbing, heating, and electrical connections can be added, but concrete slabs require additional framing on the interior of the building to allow room for needed systems. The exterior of precast slabs also requires added finishing before the building has a finished appearance.

SUMMARY OF THE INVENTION

The building slab of the invention is a framed wall unit having an intergally connected reinforced concrete outer wall that has been finished on the exterior. Each unit has a bottom edge contoured to enter a keyed footing. Adjacent units are connected by interconnecting reinforcing bar and pouring a pilaster over the joined bar. When the units are assembled into a building, only interior finishing such as plumbing, heating, and electrical systems need be completed. The method of forming a unit includes assembling a framed wall, nailing a board coating on the wall with nail heads protruding, placing reinforcing bar across the nail heads, pouring a concrete outer wall, and washing the concrete surface to provide an exposed aggregate finish.

An object of the invention is to provide a combined outer concrete wall and inner frame wall for a united and complete wall unit. When the wall is in place, no added interior construction is needed before electrical, plumbing, and heating systems are added. The building exterior is finished.

An important object is to provide a combined concrete outer wall and framed inner wall that will prevent the studs in the inner wall from warping or separating from the inner wall. Much of the lumber used in current construction is said to be overly green and subject to warping. Lumber that is kiln dried resists warping but is more expensive. When a frame wall is added inside a concrete or masonry wall, the union between the inner and outer walls is generally weak and not able to hold the frame wall in straight alignment as it was originally build, creating a serious potential for the inner wall to warp. By joining the inner frame wall to the outer concrete wall in the present invention, warpage is prevented.

Another object is to provide a concrete prefabricated building unit that is readily joined to other similar units and additional building parts. The inner framed wall has a double top plate that allows one member of the plate to be removed and replaced with a longer member that links adjacent units. The concrete outer wall retains a wooden top plate from the frame in which the concrete was cast, thus providing an attaching place for roof trusses and the like.

DESCRIPTION OF THE PREFERRED EMBODIMENT

Figure 1:
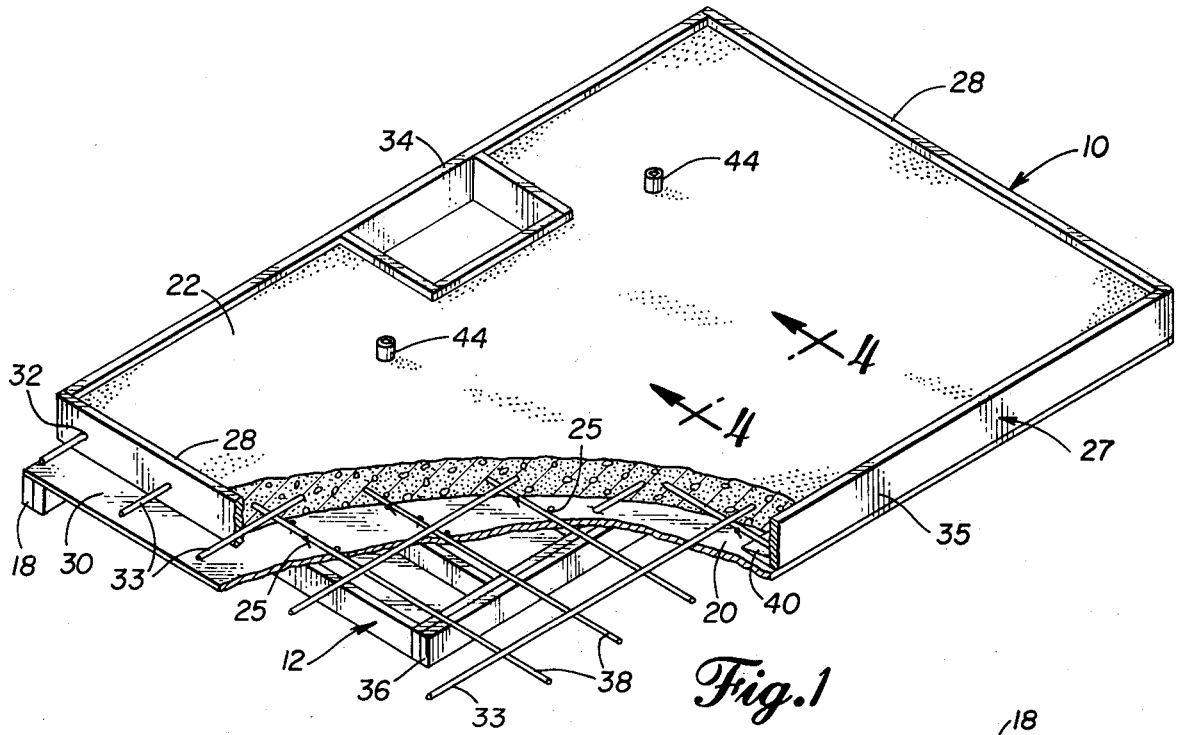
FIG. 1 is a perspective view of a building unit in horizontal position and having the concrete outer wall broken away to reveal reinforcing bar and having the intermediate wall broken away to reveal the stud wall.
Figure 2:
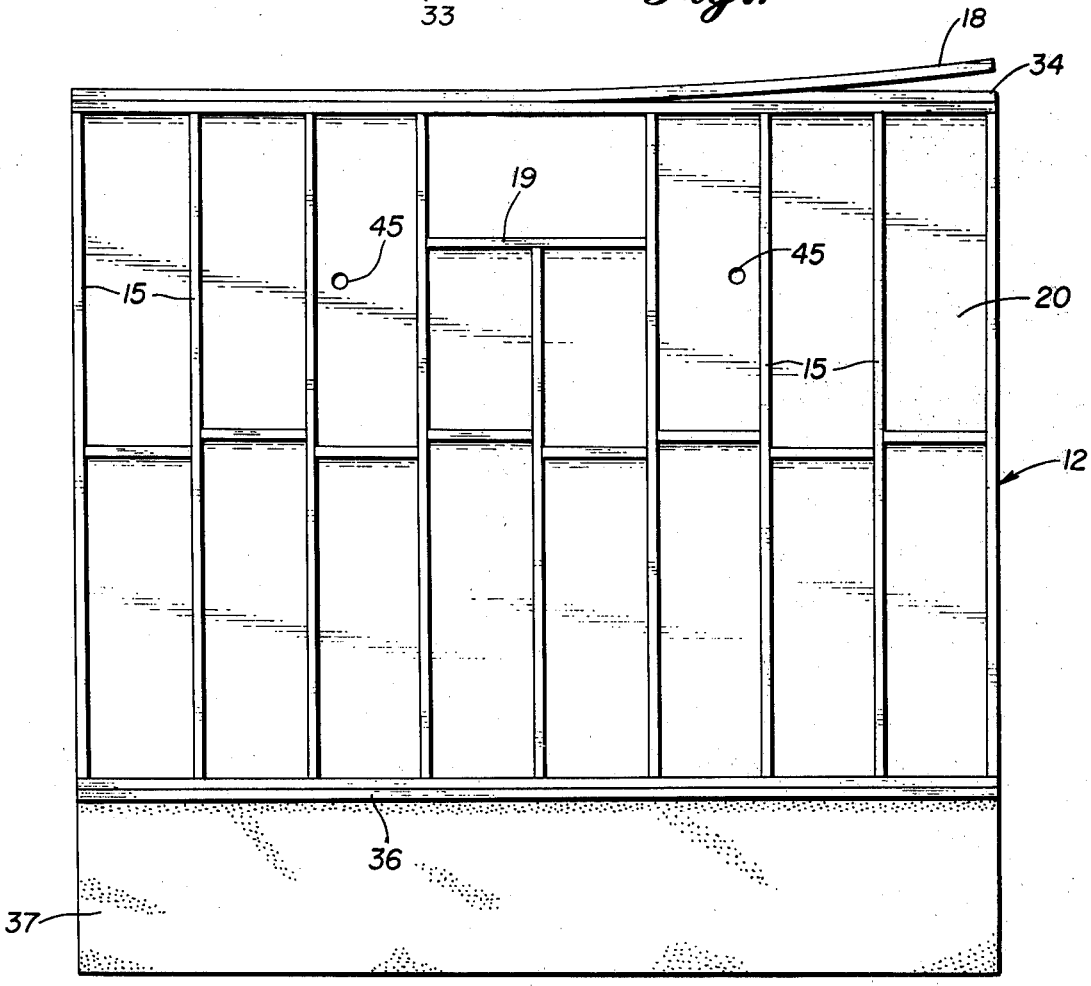
FIG. 2 is an elevational view of the interior side of the building unit showing details of construction.

The individual building unit 10 of the present invention is constructed by first building a stud wall 12 on a flat horizontal surface, as is well known in the construction industry. Wall 12 may be constructed of 2x4 boards of any desired length, but wall sections ten to twelve feet in length are a convenient size. The wall studs 15 are preferably spaced 16 inches on center, and the top plate 18 is built with two boards for double thickness, as shown in FIG. 1. The wall 12 may contain framed casings 19 for windows or doors, and when complete resembles a standard framed wall.

While the wall is horizontal, the upper side is covered with intermediate wall means such as insulation board 20, ¾ inch thick. This board provides some insulation and is the base upon which a concrete outer wall 22 will be poured. The insulation board is attached by firmly nailing the four corners to the stud wall 12, fully sinking the corner nails, thereby holding the insulation board in place and adding rigidity to the shape of the stud wall. The insulation board is then attached along the length of underlying studs with long nails 25 such as twenty penny nails, leaving a substantial length of each nail 25 extending above the insulation board, for example 2 ½ inches. The nails are angled acutely to provide locking means between the studs and the concrete wall to be poured over the nails. For example, the nails in a first stud may be angled slightly toward the top plate of the wall and the nails in the next stud may be angled toward the bottom plate of the wall. The nails in each stud may be spaced at approximately 16 inch intervals.

Frame 27 for the concrete outer wall is placed over insulation board 20 with frame side members 28 resting slightly within the side edges of wall 12 and board 20, leaving an exposed portion 30 of the inner wall, for example six inches in width. Side members 28 contain holes 32 allowing horizontal reinforcing bars 33 to rest at midthickness of the frame 27 and to extend over portion 30 of the inner wall. The top member 34 of frame 27 rests on the top member of double top plate 18, and the bottom member 35 of frame 27 may directly overlie the bottom plate 36 of stud wall 12 or, as shown in FIG. 1, extend beyond bottom plate 36 to form a foundation wall 37 when poured over a dummy support (not shown). Vertical reinforcing bar 38 extends between top and bottom members 34 and 35, respectively, but does not rest in holes in the members 34 and 35. Rather, the reinforcing bar rests on the exposed nail heads in insulation board 20. Reinforcing bar 33 and 38 are wired together at crossing points to hold them in place when concrete is poured.

Figure 5:
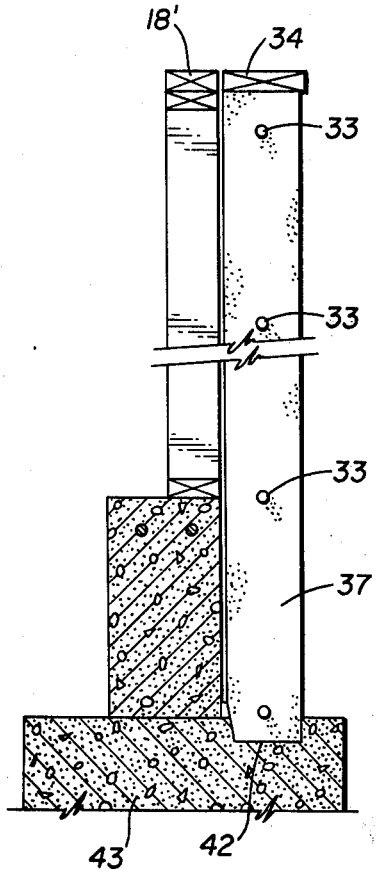
FIG. 5 is a side elevational view of a building unit in position at a construction site.

A piece of beveled wood 40 such as 2x6 may be placed adjacent to bottom frame member 35 as shown in FIG. 1 to form a wedge shaped bottom edge 42 on the concrete foundation wall. Edge 42 may later be placed in a keyed footing 43, as shown in FIG. 5. Two pipes 44 having, for example, 1 inch diameter are placed through the insulation board to leave lifting holes 45 in the finished wall. Finally, the frame 27 is filled with concrete, which covers the exposed nail heads, reinforcing bar, and beveled wood.

The concrete wall may be finished in various ways. After the concrete has set for about two hours, pipes 44 are removed, leaving holes 45 for lifting the completed wall with a crane. The surface of the concrete may be treated with a retarder and, after a day, washed to expose an aggregate finish. After the concrete has dried for about ten days the surface may be varnished with an exterior grade varnish to preserve the aggregate finish.

Figure 3:
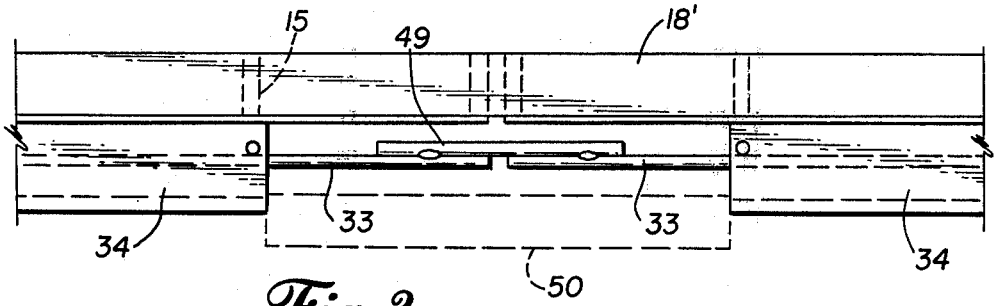
FIG. 3 is a top view of the union of two similar building units showing joined reinforcing bars and a poured pilaster.
Figure 4:
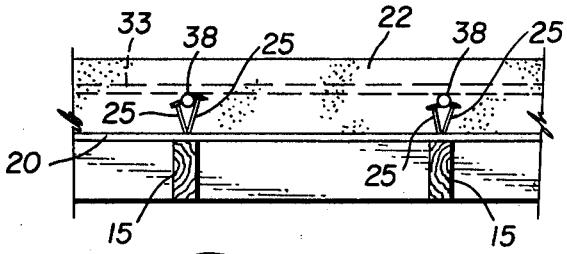
FIG. 4 is a sectional view taken along the plane of line 4—4 in FIG. 1 and showing the orientation of the stud wall, intermediate wall, concrete wall, nails and reinforcing bar.

When the concrete is sufficiently dry, members 28 and 35 of frame 27 may be removed, but top member 34 remains on the concrete outer wall as an attaching point for other building parts. Top board 18 of the double top plate on stud wall 12 is also removed to allow a longer top board 18' to overlap adjacent wall sections in an assembled building, as shown in FIG. 3.

The prefabricated wall units may be easily transported by placing a cable through lifting holes 45 and placing the unit on a truck. At the construction site, a crane removes the unit from the truck and lowers the beveled lower edge 42 of the wall into keyed footing 43, in place in the ground. Foundation wall 37 runs from the footing 43 to ground level, eliminating the need for a stem wall on the footing. When adjacent wall units are in place, they are linked by a common top plate 18' as described above. The protruding horizontal reinforcing bar 33 of adjacent wall units is joined, for example by welding a connecting bar 48 to the extended reinforcing bars, and a pilaster 50 is poured over the joined bars 33 to complete the exterior of the building. The pilaster also extends to the footing 43, making the wall extremely rigid. Holes 45 may be grounted, leaving no external attaching plates exposed on the wall surface.

Additional finish on the building may include "false pilasters" poured at intermediate points along an individual wall unit. These pilasters may be for decorative purposes and can even the spacings created by the functional pilasters above described. The interior and roof of the building may be constructed in any conventional manner, including by prefabricated construction techniques as would be obvious in light of the present disclosure.

The concrete exterior wall may be decorated in modified ways while the building unit is being fabricated. Instead of having an aggregate finish as described above, the wall may be treated with retarder when the concrete is poured and then have colored stone chips applied to the concrete surface. After a day the concrete may be washed to bring out the character of the colored chips. A striking and artistic wall exterior results from this treatment.

I claim:

1. The method of constructing a prefabricated building unit for use with similar adjacent units, comprising:

a. framing a stud wall against a flat horizontal surface,
b. nailing a coating of intermediate wall on one side of said stud wall, allowing the nail heads to protrude a substantial distance from the intermediate wall,
c. placing a frame for concrete on top of the intermediate wall,
d. placing horizontal reinforcing bars in the frame with the ends of the bars extending through holes in the sides of the frame for joining units,
e. pouring a concrete outer wall in the frame while the stud wall remains against the flat horizontal surface, the concrete holding the stud wall in a flat plane and preventing warpage of the studs,
f. washing the concrete to produce an exposed aggregate finish, and
g. raising the wall to vertical position for installation with said similar units at a building site.

* * * * *